US005454332A

United States Patent [19]

Fennelly et al.

[11] Patent Number: 5,454,332

[45] Date of Patent: Oct. 3, 1995

[54] CASH POCKET FOR AN AUTOMATIC TELLER MACHINE

[75] Inventors: John J. Fennelly; Bryan J. Rabbitte; Michael M. Heavey, all of Dublin, Ireland

[73] Assignee: Digital Equipment Corporation, Maynard, Mass.

[21] Appl. No.: 121,838

[22] Filed: Sep. 15, 1993

[51] Int. Cl.[6] ..... E06B 7/32

[52] U.S. Cl. ..... 109/19; 49/28; 109/21; 109/38; 109/58; 109/59 T; 109/66; 109/73; 221/195; 902/14; 902/31

[58] Field of Search ..... 109/59 T, 58, 109/55, 21, 38, 19, 31, 35, 24.1, 66, 73, 10; 232/43.3, 47; 221/195; 194/207; 49/28, 26; 902/14, 31, 9

[56] References Cited

U.S. PATENT DOCUMENTS

| | | | |
|---|---|---|---|
| 659,486 | 10/1900 | Mulloy | 232/47 |
| 3,836,980 | 9/1974 | Grosswiller, Jr. et al. | 109/66 X |
| 3,957,173 | 5/1976 | Roudebush | 902/31 X |
| 4,063,520 | 12/1977 | Parsons | 109/66 |
| 4,190,066 | 2/1980 | Burnside | 902/14 X |
| 4,251,009 | 2/1981 | McLaughlin et al. | 902/14 X |
| 4,340,150 | 7/1982 | Guibord et al. | 902/31 X |
| 4,429,639 | 2/1984 | Burchart | 902/14 X |
| 4,703,162 | 10/1987 | Holland-Letz et al. | 902/9 X |

FOREIGN PATENT DOCUMENTS

| | | | |
|---|---|---|---|
| 0034502 | 8/1981 | European Pat. Off. | 109/10 |

*Primary Examiner*—Lloyd A. Gall

*Attorney, Agent, or Firm*—Arthur W. Fisher; Denis G. Maloney; Lindsay G. McGuinness

[57] ABSTRACT

A cash pocket for an automatic teller machine (ATM) comprises a housing having a rear wall with a slot for receiving banknotes from the dispensing mechanism of the ATM into the housing, and a base upon which the dispensed banknotes come to lie upon being dispensed into the housing. The housing also has a front panel having an opening for the withdrawal of notes by a user of the ATM, the opening having a door which pivots about an axis substantially parallel to the longitudinal axis of the slot from a first position in which the front opening is closed to a second position in which the front opening is open for the withdrawal of dispensed banknotes. The door includes a pair of flanges which block access to the slot from the front opening when the door is open or partially open.

8 Claims, 9 Drawing Sheets

CASH POCKET FOR AN AUTOMATIC TELLER MACHINE

FIELD OF THE INVENTION

This invention relates to electro-mechanical banking machines, and more particularly, a cash pocket for automatic teller machines (ATM).

BACKGROUND

In recent years, personal banking services have improved through the advent of ATMs. These machines allow certain banking transactions to be accomplished without the need of an interface with a human bank teller. Bank customers, through of use of a banking card and known personal identification numbers, can access and operate the ATM to conduct various banking transactions, such as making cash deposits, withdrawals, account transfers and the like.

However, since these ATMs are located in areas typically absent of banking personnel, e.g., in unattended building lobbies, stand-alone kiosks, etc. and have money contained therein for dispensing to banking customers, such can lend itself as an attractive source of money theft by criminal elements.

Some designs of ATMs have cash pockets located behind an access door. The cash pockets are receptacles where money dispensed from within the ATM rests for easy retrieval by the bank customer using the ATM. However, there have been schemes by such criminals where attempts have been made to steal money at the dispensing element or from within the cash pocket.

What is needed is an improved cash pocket for ATMs which can help maintain the security of the ATM.

SUMMARY OF THE INVENTION

According to the present invention there is provided a cash pocket for an automatic teller machine (ATM), comprising a housing having a rear wall with a slot for receiving banknotes from the dispensing mechanism of the ATM into the housing, a base upon which the dispensed banknotes come to lie upon being dispensed into the housing, and a front wall having an opening for the withdrawal of notes by a user of the ATM, the opening having a door which pivots about an axis substantially parallel to the longitudinal axis of the slot from a first position in which the front opening is closed to a second position in which the front opening is open for the withdrawal of dispensed banknotes, the door having means which blocks access to the slot from the front opening when the door is open or partially open.

BRIEF DESCRIPTION OF THE DRAWINGS

An embodiment of the invention will now be described, by way of example, with reference to the accompanying drawings, in which.

DETAILED DESCRIPTION

Figure 1:
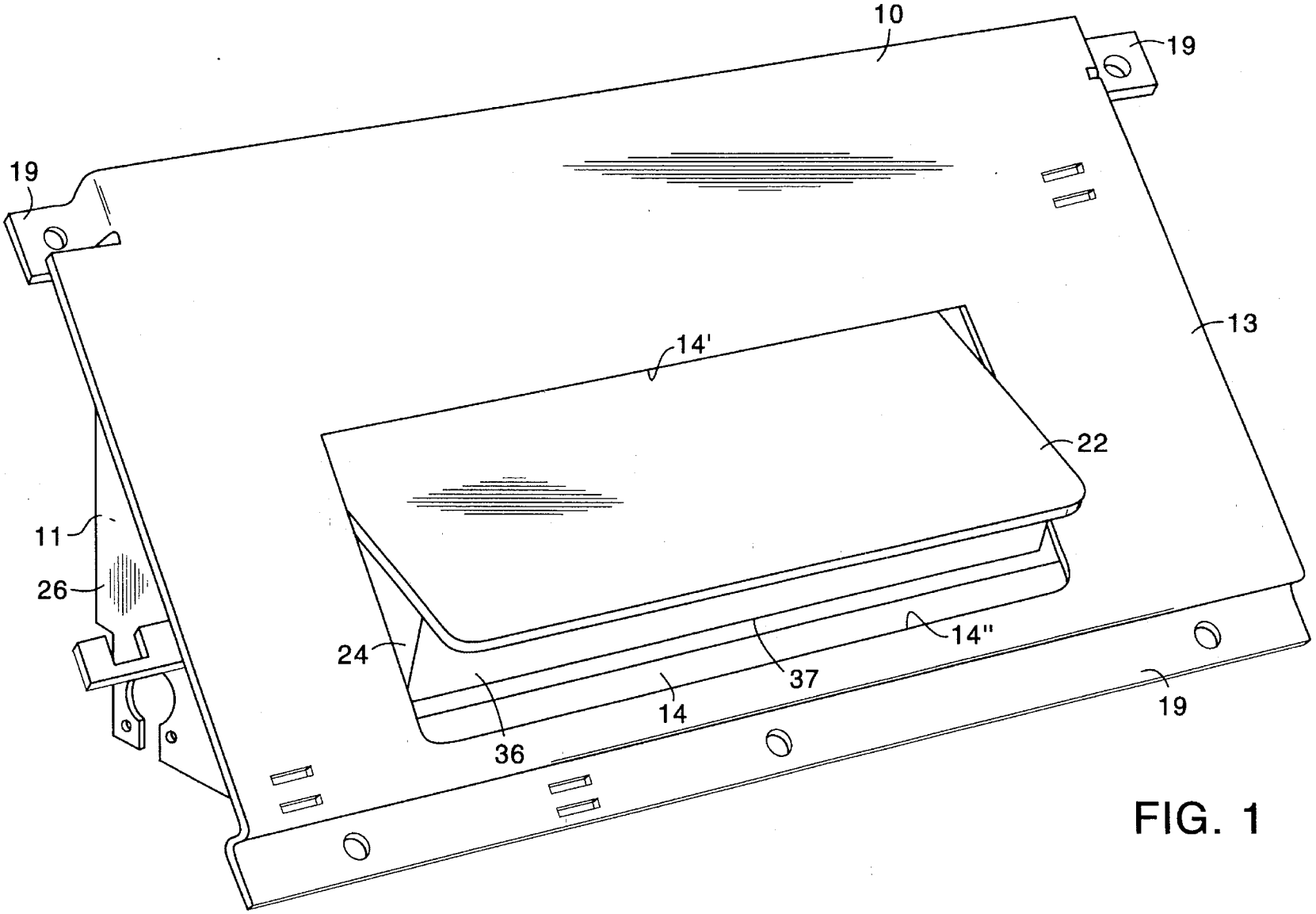
FIG. 1 is a front perspective view of a cash pocket according to the embodiment.
Figure 2:
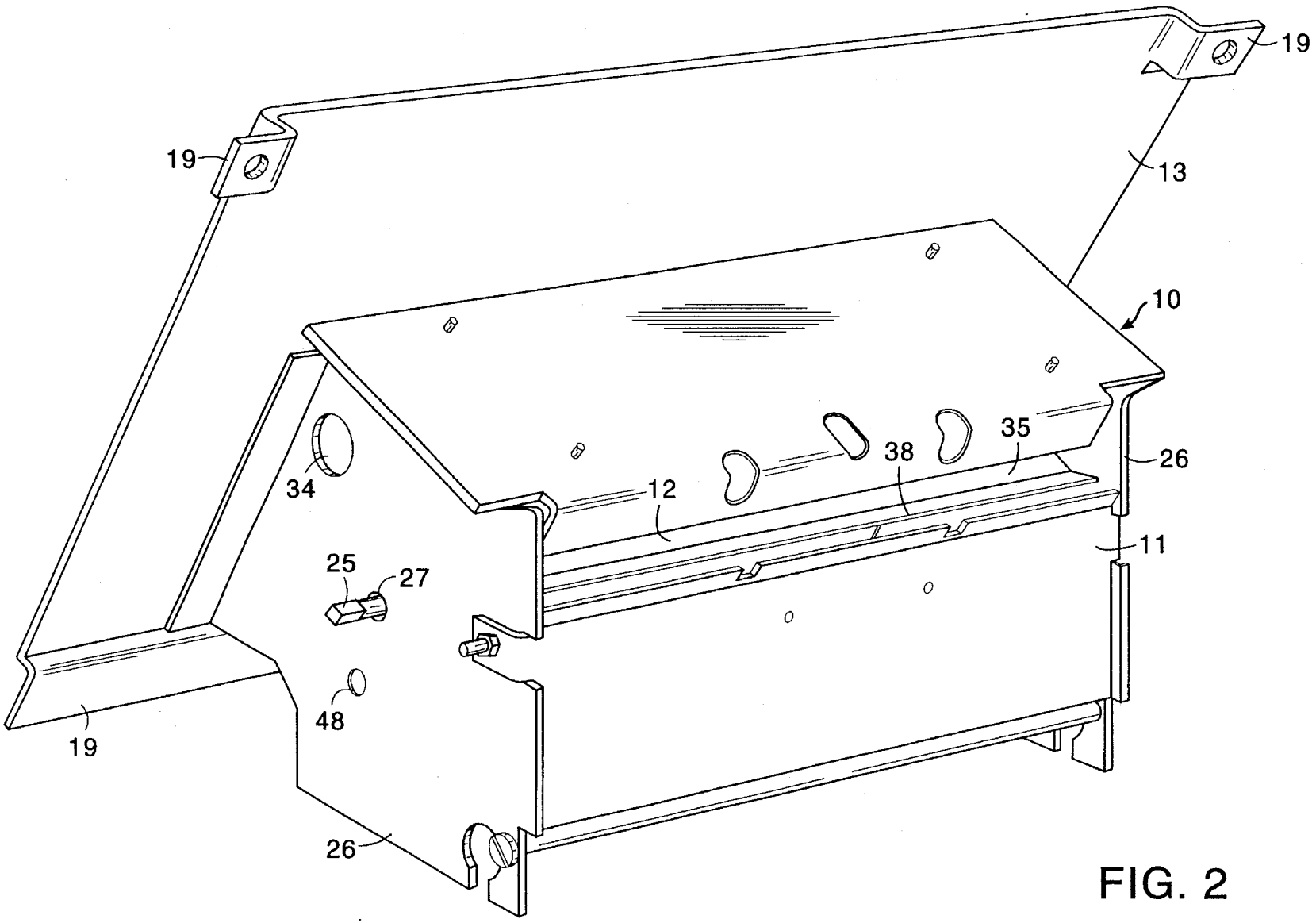
FIG. 2 is a rear perspective view of the cash pocket of FIG. 1.

Referring now to the drawings, the cash pocket for an automatic teller machine comprises a housing 10 having a rear wall 11 provided with a substantially horizontal slot 12 for receiving banknotes from the dispensing mechanism of the ATM into the housing, and a front panel or wall 13 having a substantially horizontal opening 14, whose top and bottom edges are indicated at 14' and 14" respectively, to permit the withdrawal of notes by a user of the ATM. The main body of the ATM is indicated diagrammatically at the left hand side of FIG. 5, and comprises a strongbox 15 containing a supply of banknotes (not shown) for dispensing by the ATM to customers, and a dispensing mechanism indicated schematically by a pair of feed rollers 16 which acts to feed banknotes along the dashed path 17 into the housing 10 through the slot 12. The construction of the dispensing and other mechanisms inside the strongbox 15 which act to supply banknotes upon customer demand into the cash pocket may be entirely conventional, and do not form part of the present invention. The cash pocket is fixedly mounted in front of the exit aperature 18 of the strongbox 15 inter alia by means of the various mounting flanges 19 shown particularly in FIGS. 1 to 3, the external face of the front panel 13 being flush with an upwardly and rearwardly sloped fascia panel 20 of the ATM. The fascia panel 20 may contain the other usual input and output devices of the typical ATM, such as a CRT and keypad (not shown).

Upon entering the housing 10 through the slot 12, the banknotes come to lie upon a base 21 of the housing 10. In order to permit withdrawal of dispensed banknotes by an authorised user of the ATM, yet otherwise prevent access to the cash pocket, the opening 14 in the front panel 13 has a door 22 which pivots about an axis 23 substantially parallel to the longitudinal axis of the slot 12, from a first positon (FIG. 5) in which the front opening 14 is closed to a second position (indicated by the line 22' in FIG. 6) in which the front opening 14 is open for the withdrawal of dispensed banknotes. It is to be understood that the solid lines in FIG. 6 show the door in a partially open position, corresponding to the perspective view of FIG. 1.

In particular, the door 22 has a pair of rearwardly extending substantially vertical side flanges 24 at opposite side edges thereof, and each side flange has an outwardly directed stub axle 25, the stub axles being aligned on a common axis. Further, the cash pocket housing 10 has substantially vertical side walls 26 provided with respective aperatures 27 which are aligned on an axis substantially parallel with the longitudinal axis of the slot 12. The door 22 fits snugly between the housing side walls 26 with a respective stub axle 25 extending through a respective aperture 27 on each side of the door 22, the apertures 27 forming bearings for the stub axles permitting rotation of the door 22 between the closed and open position as aforesaid. The door 22 is driven from its closed to open positions by a gear train 28 and motor 29 shown at the left hand side of FIG. 3, as will be described in more detail later.

Figure 8:
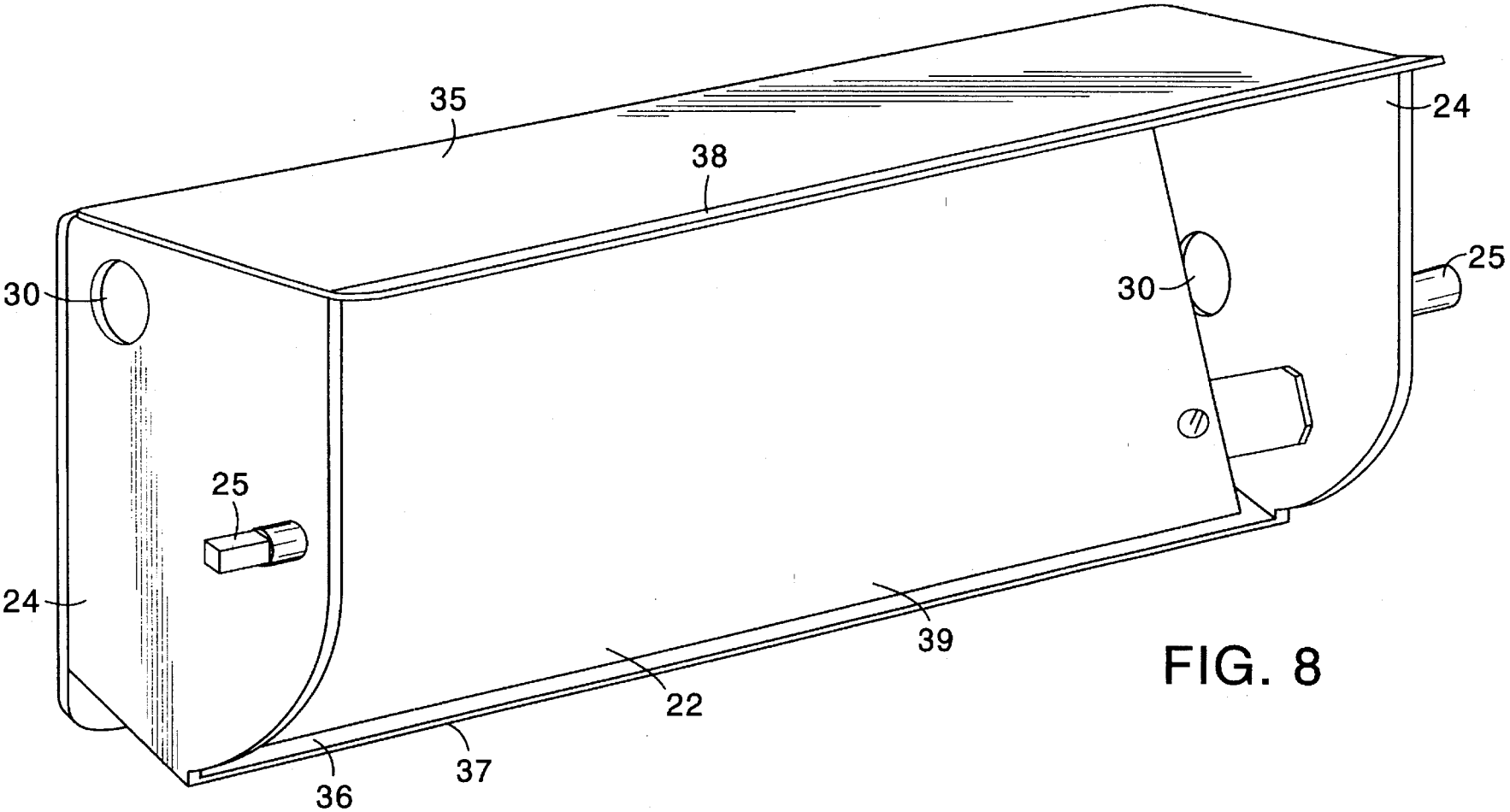
FIG. 8 is a rear perspective view of the door of FIG. 7.

As a security measure to prevent or hinder an unauthorized person trying to lever up the door 22 from outside to gain access to the cash pocket, each rearwardly extending side flange 24 has a respective circular aperture 30, and the cash pocket comprises a pair of retractable solenoid-operated bolts (FIG. 3) one on each side of the door, the respective solenoid housings being shown at 31 and the respective bolts extending therefrom being shown at 32. The solenoid housings are mounted on the exterior of the side walls 26 of the housing 10, and immediately in front of each bolt 32 the respective side wall 26 has a circular aperture 34 (FIGS. 2 and 6) which, in the closed position of the door 22, coincides with the circular aperture 30 in each door side flange 24. This permits each bolt to pass inwardly through the aperture 34 in the respective side wall 26 into engagement with the respective door aperture 30 when the door is closed to hinder forcible unauthorized opening of the door. However, by operation of the associated solenoids the bolts 32 are retractable out of the door apertures 30, each in a direction substantially parallel to the pivot axis of the door, to permit the door 22 to be opened by the motor 29 to enable dispensed banknotes to be removed from the cash pocket by authorized users. As a further security measure, it will be seen especially from FIG. 8 that the axes along which the two bolts 32 are retracted are substantially mis-aligned.

As a further security measure, to prevent or hinder access to the rear slot 12 from outside the cash pocket through the fully or partially opened door 22, the door is so constructed as to block access to the slot 12 from the front opening 14 when the door 22 is open or partially open.

To this end the door 22 has a first or upper rearwardly extending flange 35 at or near the top edge of the front panel 13, and a second or lower rearwardly extending flange 36 at or near the bottom edge of the front panel. Since the pivot axis 23 of the door 22 is behind the front panel at a vertical height between the upper and lower flanges 35 and 36, when the door 22 opens an upper part of the front panel 13 carrying the upper flange 35 rotates rearwardly into the housing 10 and a lower part of the front panel 13 carrying the lower flange 36 rotates forwardly out of the housing. The design of these elements is such that the upper flange 35 moves progressively across the slot 12 to fully cover the latter against access from the front opening 14 no later than the free edge 37 of the lower flange 36 clears the bottom edge 14" of the front opening 14. This is the position seen in FIG. 6.

Figure 5:
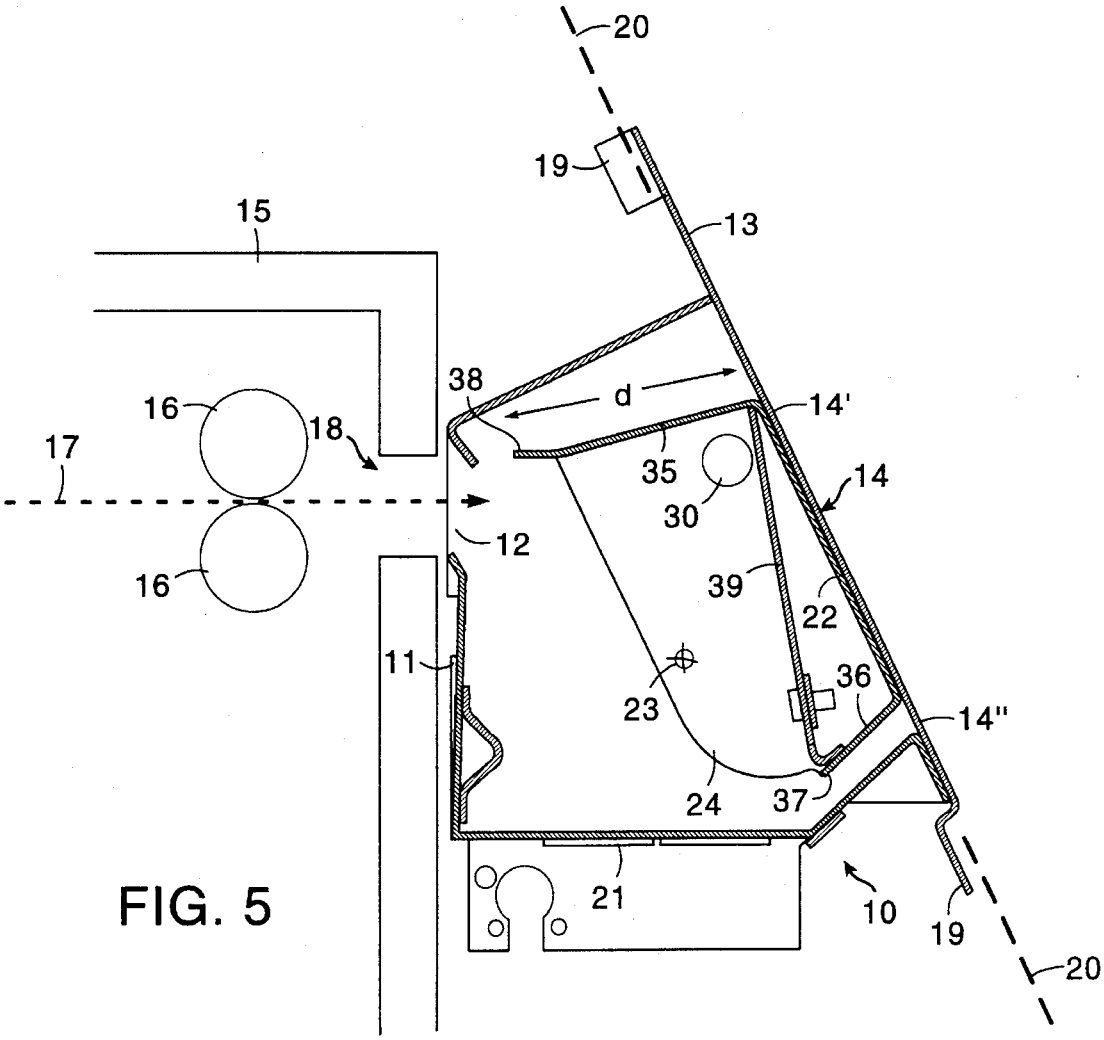
FIG. 5 is a cross-sectional view of the cash pocket with its door in the closed position.
Figure 6:
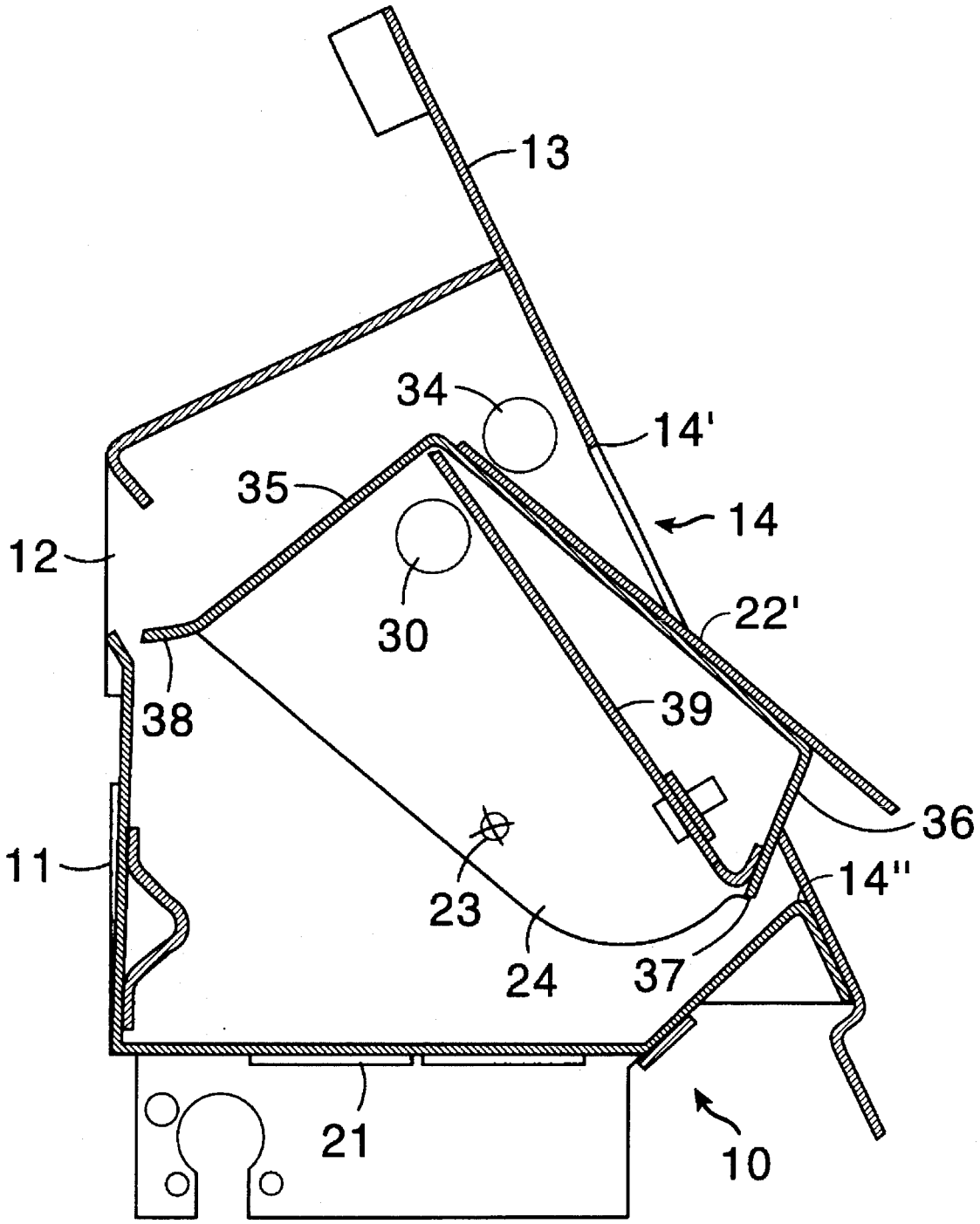
FIG. 6 is a cross-sectional view of the cash pocket with its door in the open position.
Figure 7:
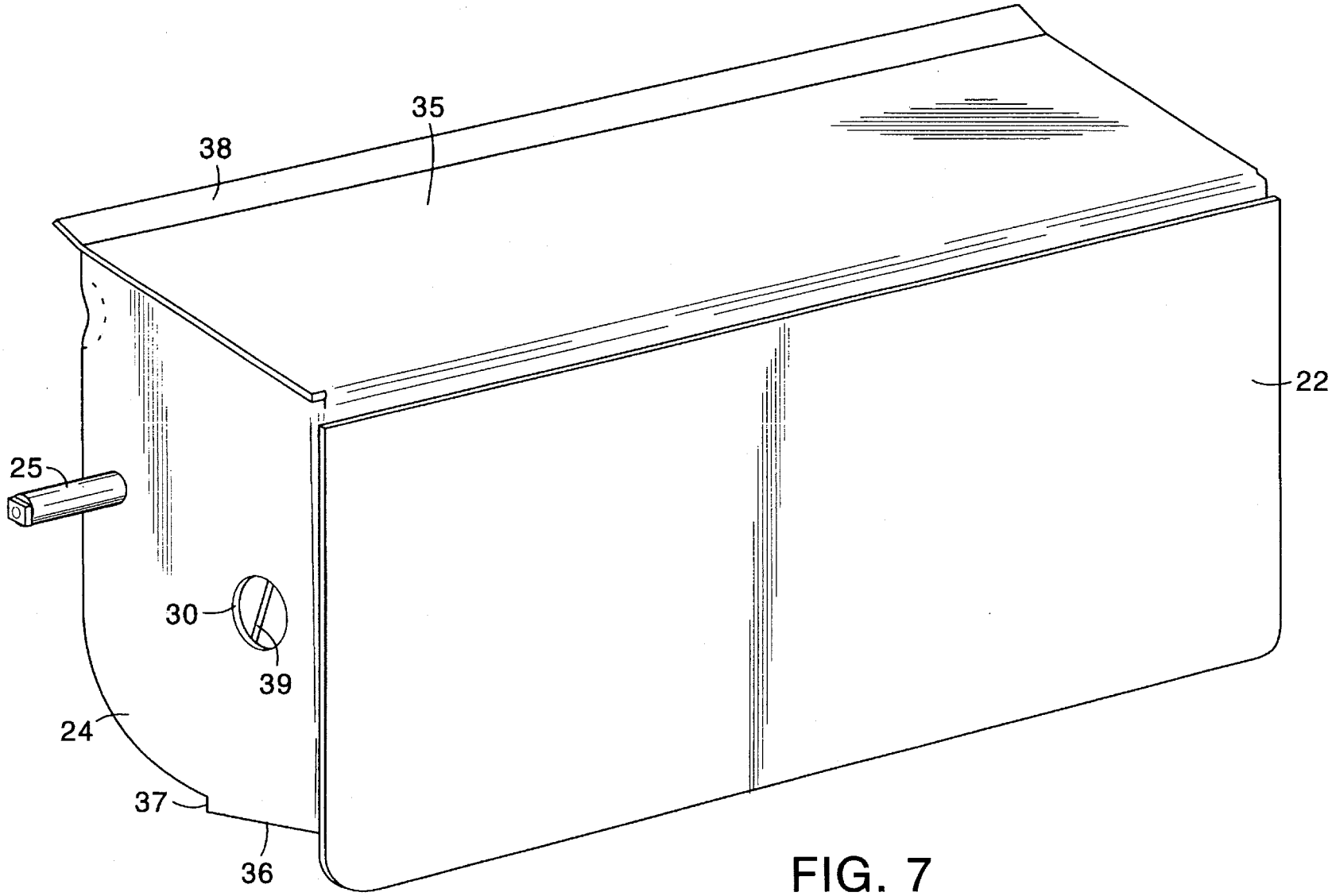
FIG. 7 is a front perspective view of the door of the cash pocket.

To permit the upper flange 35 to be as long as possible in the front to rear direction d, FIG. 5, thereby permitting a greater height of the rear slot 12, the free edge of the upper flange 35 adjacent to the upper edge of the slot 12 in the closed position of the door 22 has a lip 38 which is upturned relative to the plane of the flange 35. This permits the extra length to be obtained while avoiding the possibility that dispensed banknotes may become lodged on top of the flange 35.

In order to prevent dispensed banknotes, which are often electrostatically charged after their passage through the dispensing mechanism 16, from sticking to the rear surface of the door rather than falling to the base 21, an anti-static plate 39 is mounted behind and on the door 22. The plate 39, or at least the surface thereof facing the slot 12, is of conductive material, and the plate or conductive surface is grounded to discharge static electricity which may have built up on dispensed banknotes.

The cash pocket and indeed the overall ATM is controlled in generally known manner by a microprocessor (not shown), which takes its input from various sensors and input devices associated with the ATM and cash pocket to determine the current state of the ATM. Generally, the manner in which such control is exercised is well-known, and does not need explanation here. However, in the present case we wish to detect and provide as input to the microprocessor the presence or absence of notes resting on the base 21 of the housing 10. This is important because the ATM needs to know if banknotes which have been dispensed have properly come to rest on the base 21 or have, for example, become lodged elsewhere in the machine through some mechanical fault.

Figure 4:
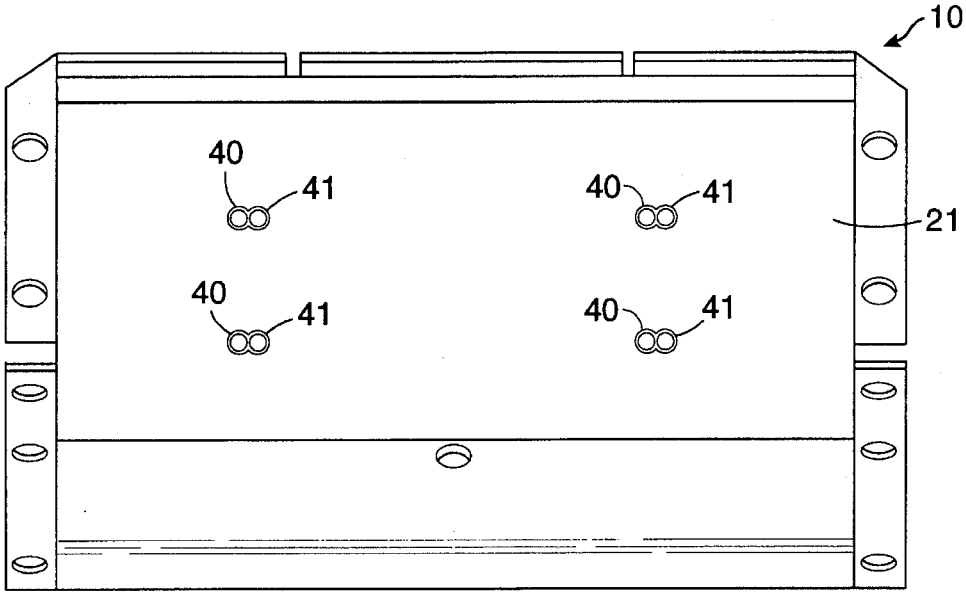
FIG. 4 is an underneath view of the cash pocket, omitting the front panel.
Figure 9:
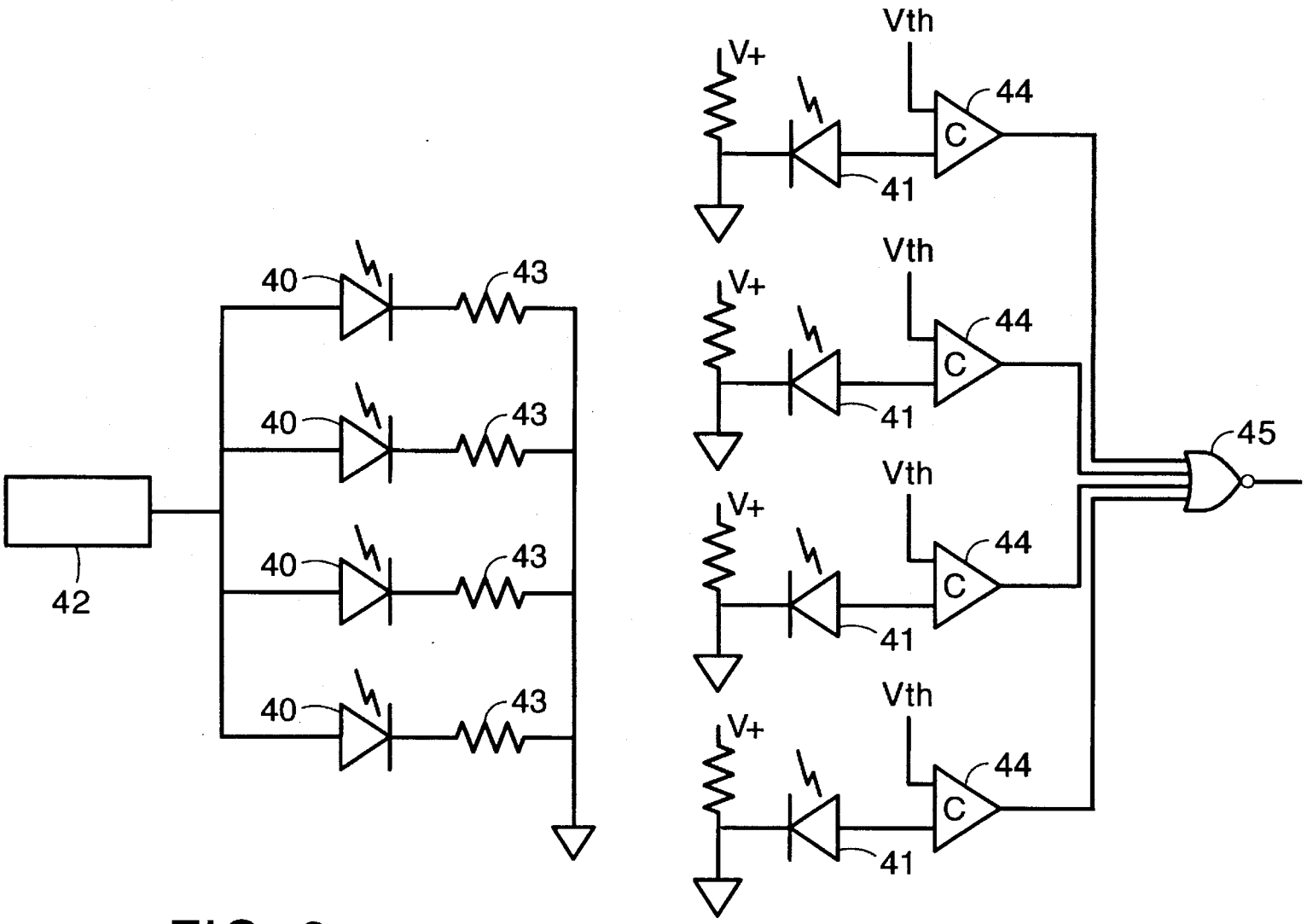
FIG. 9 is a circuit diagram of the emitter/detector pairs mounted in the base of the cash pocket.

To this end, four pairs of light emitters (LEDs) 40 and light detectors 41 are mounted in the base 21, FIG. 4, facing into the interior of the housing 10. In each emitter/detector pair the emitter 40 may be an infra red LED, and the associated detector 41 may be a light sensitive diode whose reverse current is a function of the level of light, of the wavelength emitted by the respective emitter, detected by the diode. Each LED 40 emits its infra red light in a narrow upward beam, so that it does not directly illuminate the associated diode 41. The electrical circuit for these emitter/detector pairs is shown in block diagram form in FIG. 9.

The LEDs 40 are pulsed on at, for example 1 second intervals, by a driver circuit 42. The nature of the driver circuit 42 is not important, but it is under the control of the microprocessor. A resistor 43 limits the output level of each LED. The diodes 41 are reversed biased, and the level of reverse current flowing in each is determined by the level of light received by it from the associated LED 40. An amplifier/comparator 44 amplifies the reverse current and compares it with a preselected threshold established by a threshold voltage Vth, and provides a logical "1" output when the threshold is exceeded. The threshold level is selected in conjunction with the value of the resistors 43 such that in the absence of any banknote resting on or closely over an emitter/detector pair the amount of light detected by a diode 41 due to internal reflections inside the housing is insufficient for the threshold level at the comparator 44 to be exceeded. However, these parameters are selected such that when a banknote is resting on or closely over a emitter/detector pair the light from the LED 40 scattered onto the associated diode 41 is sufficient for the threshold level at the respective comparator 44 to be exceeded. In this case the comparator 44 provides a logic "1" to a NOR gate 45. A logic "1" from any single comparator is sufficient to generate a logic "0" output from the NOR gate 45, which is interpreted by the microprocessor to mean that it has detected a banknote lying on the base 21.

While four emitter/diode pairs have been shown, one could use more or less pairs. However, these should be arranged in a two-dimensional array on the base 21 to give a reasonable spread, and thus at least three such pairs should be used.

Figure 3:
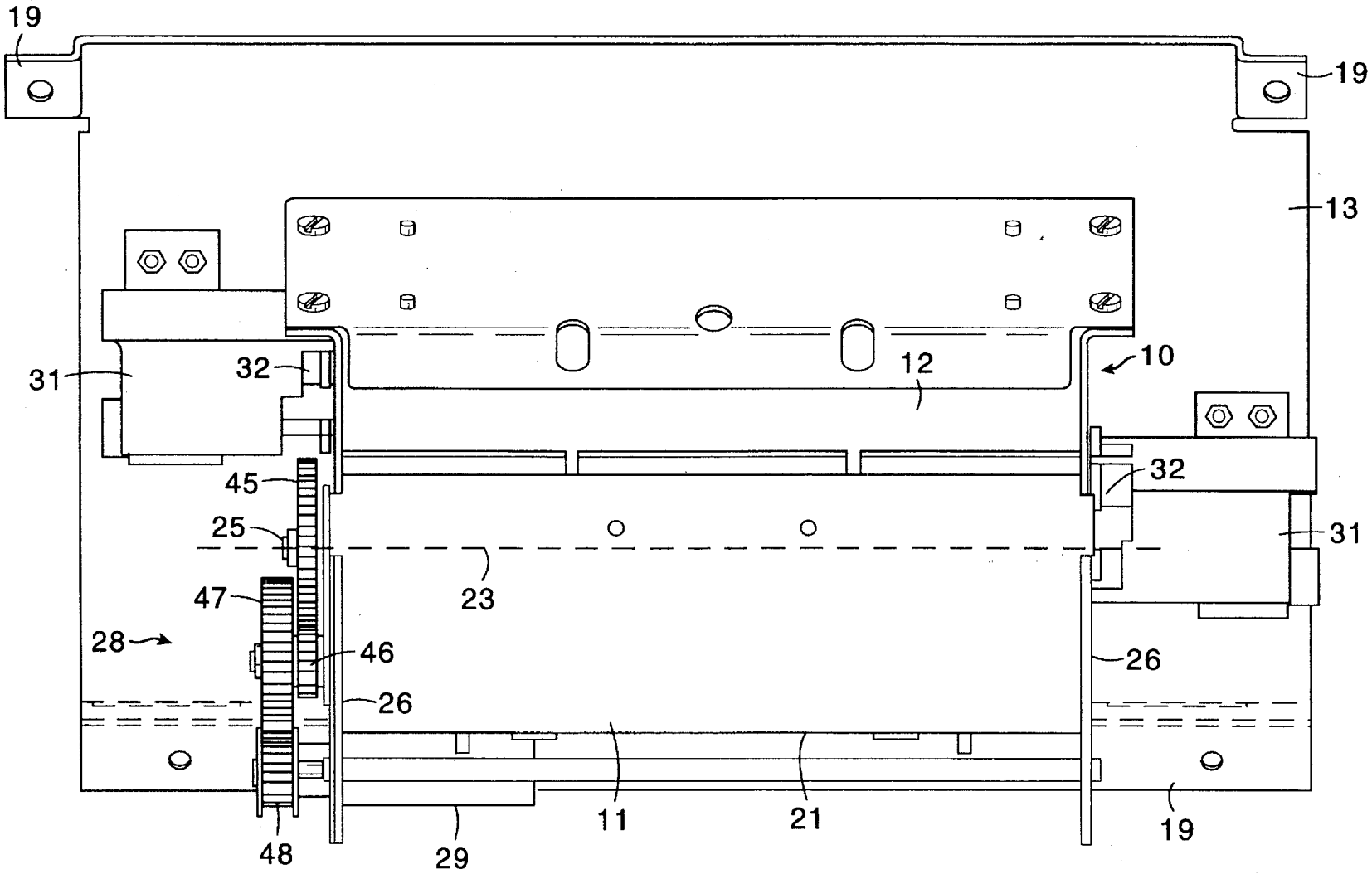
FIG. 3 is rear view of the cash pocket.

Turning now primarily to FIG. 3, the operation of the gear train 28 and motor 29 will now be described. One stub axle 25 of the door 22 has a square cross-section where it projects from the housing side wall 26, FIG. 2, and this non-rotatably carries a gear wheel 45. The latter meshes with a smaller diameter gear wheel 46 which is co-axially fixed to a larger gear wheel 47 for rotation therewith. The latter two gear wheels 46 and 47 rotate about an axle which is mounted in a bearing hole 48 (FIG. 2) in the side wall 26. The gear wheel 47 in turn meshes with a further small gear wheel 48 which is driven by the motor 29. Thus the gear train 28 constitutes a step down gear train which converts a fast motor speed to a gradual opening and closing of the door 22. The control of the motor 29 to open and close the door 22 may be conventional; however, the present embodiment includes circuit means associated with the motor 29 for detecting when an object (for example a person's finger) is obstructing the closing of the door 22 and for temporarily reversing the direction of movement of the door 22 upon such detection.

Figure 10:
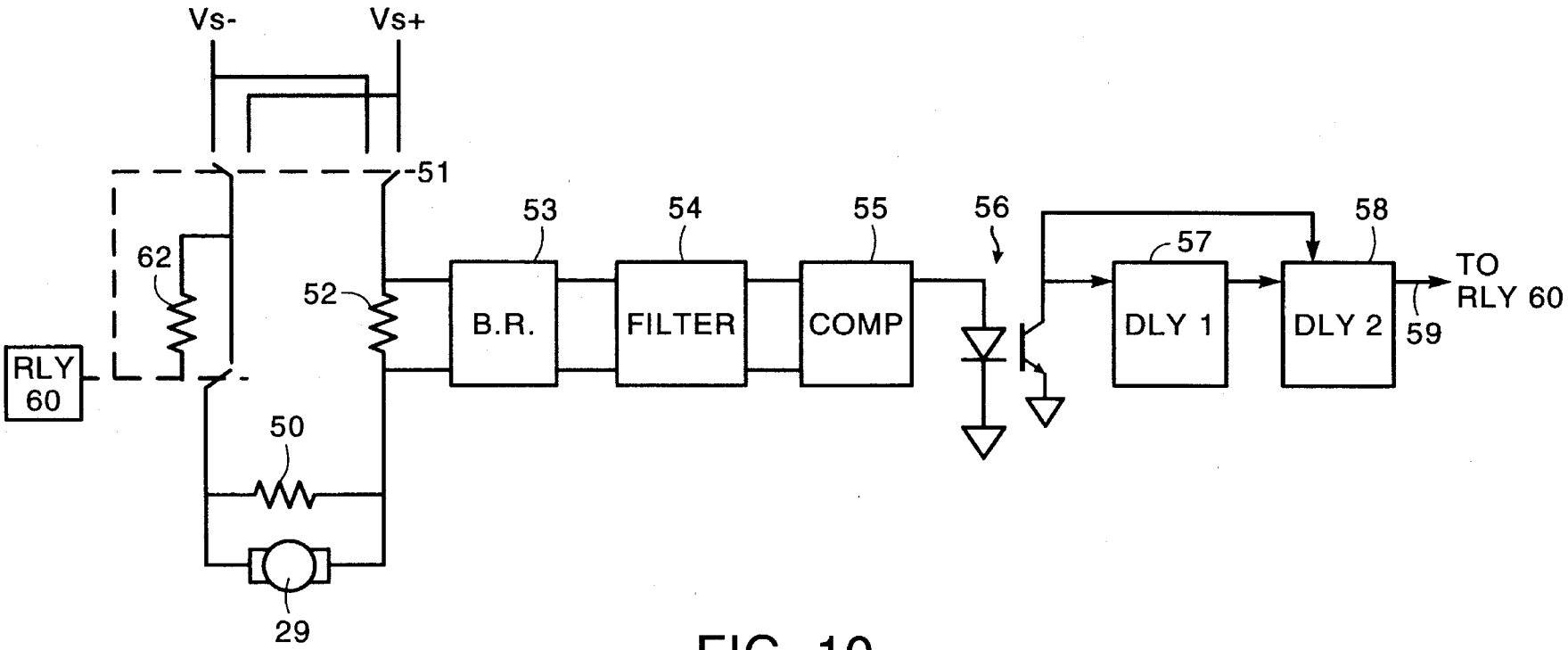
FIG. 10 is a circuit diagram of the automatic reversal mechanism for the door of the cash pocket.

Thus, referring to FIG. 10, the motor 29 is a bi-directional motor having positive and negative supply voltages Vs+ and Vs−. According to the position of relay switchover contacts 51, either the motor is driven in a forward direction to close the door 22, or in the reverse direction to open the door. In FIG. 10 it is assumed that with the relay contacts in the position shown the motor 29 is closing the door. A resistor 50 across the motor 29 attenuates speed variations from motor to motor.

The current taken by the motor 29, as measured by the voltage drop across a resistor 52, is monitored by the circuit to the right of the resistor 52. Thus the voltage across the resistor 52 is rectified in a bridge rectifier 53 and smoothed in a filter 54. The smoothed voltage is compared in a comprator 55 with a preset threshold level. The threshold level is selected such that in normal operation of the motor, where the door is free to close without obstruction, the monitored voltage drop across the resistor 52 will not exceed the threshold level, and no ouptut will be provided by the comparator 55.

However, if the door 22 is obstructed while the motor 29 is attempting to close it, there will be a significant back EMF across the resistor 52, and this will cause the threshold level of the comparator 55 to be exceeded. In such case the comparator 55 will provide an output. This output is provided, across an opto-coupler 56 for isolation, to the trigger input of a first monostable device 57 which, after a delay of 0.5 seconds, provides an output to the trigger input of a second monostable 58. The input to the first monostable 57 is also applied to the enable input of the second monostable 58, such that the second monostable 58 provides an output on line 59, of duration one second, only if the input to the first monostable 57 is maintained for at least 0.5 seconds. In other words, the obstruction causing the back EMF has to be present for at least 0.5 seconds for there to be a signal on the output 59.

A signal on the output 59 switches over the relay 60 for the duration of such signal, so that the contacts 51 are switched over to reverse the direction of the motor 29 for one second. This opens the door 22 slightly to permit the obstruction to be removed. As well as reversing the direction of the motor 29 the relay 60 also switches in a resistor 62, so that the rate of opening is substantially decreased compared to the forward closing movement, so that the degree of opening is just sufficient to relieve the pressure on the obstructing object.

We claim:

1. A cash pocket for an automatic teller machine (ATM), comprising:

a) a housing having a rear wall with a slot for receiving banknotes from a dispensing mechanism of the ATM into the housing;

b) a base upon which the dispensed banknotes come to lie upon being dispensed into the housing; and c) a front wall having an opening for the withdrawal of notes by a user of the ATM, the opening having a door which pivots about an axis substantially parallel to longitudinal axis of the slot from a first position in which the front opening is closed to a second position in which the front opening is open for the withdrawal of dispensed banknotes, wherein said door has a front plate which in the closed position of the door closes the front opening, and upper and lower flanges each extending rearwardly from the front plate, and wherein the pivot axis of the door is behind the front plate at a vertical height between the upper and lower flanges such that when the door opens a lower part of the front plate carrying the lower flange rotates forwardly out of the housing, the upper flange moving progressively across the slot to fully cover the latter against access from the front opening no later than when a free edge of the lower flange clears a bottom edge of the front opening.

2. A cash pocket as claimed in claim 1, wherein a free edge of the upper flange adjacent to an upper edge of the slot in the closed position of the door has an upturned lip.

3. A cash pocket as claimed in claim 1, wherein the door further includes a pair of rearwardly extending side flanges at opposite sides thereof, each side flange having an aperture, and the cash pocket comprises a pair of retractable bolts one on each side of the door, each bolt extending into a respective aperture when the door is closed to hinder forcible unauthorized opening of the door.

4. A cash pocket as claimed in claim 3, wherein the two bolts lie on respective axes which are substantially misaligned.

5. A cash pocket as claimed in claim 1, further including an anti-static plate mounted behind the door of which at least the surface of the plate facing the slot is of conductive material, the anti-static plate or conductive surface thereof being grounded to discharge static electricity which may have built up on dispensed banknotes.

6. A cash pocket as claimed in claim 1, further including at least three light emitter and light detector pairs mounted in the base, the emitter and detector of each pair being located in close proximity and the pairs being arranged in a two-dimensional array, and circuit means for activating each emitter and sensing the level of light detected by each detector, the circuit means being adapted to provide a signal to an emitter/detector pair only when a banknote is resting on or closely over that pair.

7. A cash pocket is claimed in claim 1, further including a motor to open and close the door, and circuit means associated with the motor for detecting when an object is obstructing the closing of the door and for temporarily reversing the direction of movement of the door upon such detection.

8. A cash pocket for an automatic teller machine (ATM), comprising:

a) a housing having a rear wall with a slot for receiving banknotes from a dispensing mechanism of the ATM into the housing;

b) a base upon which the dispensed banknotes come to lie upon being dispensed into the housing; and c) a front wall having an opening for the withdrawal of notes by a user of the ATM, the opening having a door which pivots about an axis substantially parallel to a longitudinal axis of the slot from a first position in which the front opening is closed to a second position in which the front opening is open for the withdrawal of dispensed banknotes, the door having means which blocks access to the slot from the front opening when the door is open or partially open by having a front plate which in the closed position of the door closes the front opening, and upper and lower flanges each extending rearwardly from the front plate, and wherein the pivot axis of the door is behind the front plate at a vertical height between the upper and lower flanges such that when the door opens a lower part of the front plate carrying the lower flange rotates forwardly out of the housing, the upper flange moving progressively across the slot to fully cover the latter against access from the front opening no later than when a free edge of the lower flange clears a bottom edge of the front opening;

d) an anti-static plate mounted behind the door of which at least the surface of the plate facing the slot is of conductive material, the anti-static plate or conductive surface thereof being grounded to discharge static electricity which may have built up on dispensed banknotes;

e) at least three light emitter and light detector pairs mounted in the base, the emitter and detector of each pair being located in close proximity and the pairs being arranged in a two-dimensional array, and circuit means for activating each emitter and sensing the level of light detected by each detector, the circuit means being adapted to provide a signal to an emitter/detector pair only when a banknote is resting on or closely over that pair; and f) a motor to open and close the door, and circuit means associated with the motor for detecting when an object is obstructing the closing of the door and for temporarily reversing the direction of movement of the door upon such detection.

* * * * *